US010179467B2

(12) United States Patent
Komori et al.

(10) Patent No.: US 10,179,467 B2
(45) Date of Patent: Jan. 15, 2019

(54) PRINTING APPARATUS

(71) Applicant: CANON KABUSHIKI KAISHA, Tokyo (JP)

(72) Inventors: Masateru Komori, Yokohama (JP); Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/660,495

(22) Filed: Jul. 26, 2017

(65) Prior Publication Data

US 2018/0029394 A1 Feb. 1, 2018

(30) Foreign Application Priority Data

Jul. 29, 2016 (JP) ..... 2016-149981

(51) Int. Cl.

| | |
|---|---|
| ***B41J 25/308*** | (2006.01) |
| ***B41J 11/20*** | (2006.01) |
| ***B41J 19/00*** | (2006.01) |
| ***B41J 25/316*** | (2006.01) |
| *B41J 3/407* | (2006.01) |

(52) U.S. Cl.

CPC ..... *B41J 25/308* (2013.01); *B41J 11/20* (2013.01); *B41J 19/00* (2013.01); *B41J 25/316* (2013.01); *B41J 3/407* (2013.01)

(58) Field of Classification Search

CPC ..... B41J 25/308; B41J 11/20

See application file for complete search history.

(56) References Cited

U.S. PATENT DOCUMENTS

| | | | | |
|---|---|---|---|---|
| 6,068,374 | A * | 5/2000 | Kurata | B41J 3/4078 347/100 |
| 9,889,687 | B2 * | 2/2018 | Watanabe | B41J 15/16 |
| 2003/0039499 | A1 | 2/2003 | Kelley et al. | |
| 2010/0201743 | A1 | 8/2010 | Miyata | |

FOREIGN PATENT DOCUMENTS

| | | | |
|---|---|---|---|
| CN | 101318416 | A | 12/2008 |
| CN | 101456303 | A | 6/2009 |
| CN | 103009831 | A | 4/2013 |
| CN | 103182860 | A | 7/2013 |
| CN | 105275985 | A | 1/2016 |
| JP | 2010023501 | A | 2/2010 |

* cited by examiner

*Primary Examiner* — Lamson Nguyen

(74) *Attorney, Agent, or Firm* — Canon U.S.A., Inc. IP Division

(57) ABSTRACT

An interval switching member that relatively displaces a carriage with respect to a printing medium in a direction orthogonal to a printing surface of the printing medium is provided between the carriage and a first guide member, and between the carriage and a second guide member. Subsequently, an inclination control member that changes a distance between the carriage and the first guide member is provided between the carriage and the first guide member. By changing the distance between the carriage and the first guide member with the inclination control member, the carriage rotates about a second guide rail serving as a central axis, such that an angle of the printing head against the printing medium is changed.

19 Claims, 12 Drawing Sheets

PRINTING APPARATUS

BACKGROUND OF THE INVENTION

Field of the Invention

The present disclosure relates to a printing apparatus.

Description of the Related Art

In a printing apparatus that performs printing by ejecting ink on a printing medium from a discharge opening provided in a printing head, an image is printed with the printing head mounted in a carriage that moves along the printing medium. An operation in which, after printing amounting to a single line is completed, the printing medium is sent by a predetermined amount is repeated, such that printing is performed on the entire printing medium. The carriage is supported by guide rails, guide shafts, and the like. By having the printing medium be supported on a supporting member, such as a platen, the distance between the printing head held by the carriage and the printing medium is kept the same in an area in which the carriage moves reciprocally.

The distance between the printing head and the printing medium has an effect on the accuracy of the printing formed on the printing medium. For example, in a case of an ink jet printing apparatus in which printing, such as an image, is formed with the printing apparatus by ejecting printing liquid, such ink or the like, on the printing medium, the distance between the printing head and the printing medium has an effect on the printing accuracy of the image. For example, in the case of the ink jet printing apparatus, plain paper, glossy paper for photography printing, a postcard, and an envelope are the printing medium, and each of the thicknesses thereof is different. When the distance between the printing head and the printing medium changes due to the thickness of the printing medium, there is an effect on the printing accuracy, such that, disadvantageously, there may be cases in which printing in the desired quality cannot be performed. Furthermore, in a case in which thin paper, such as plain paper, is used as the printing medium, creases may be created by the printing liquid ejected towards the printing medium such that unevenness is created on the surface of the printing medium. In such a case, there is a concern that the printing medium may be scratched by the printing head.

Accordingly, printing apparatuses that change the distance between the printing head and a platen or the like that supports the printing medium to maintain the distance between the printing surface of the printing medium and the printing head uniform or to change the distance in accordance to the type of printing medium have been proposed. For example, Japanese Patent Laid-Open No. 2010-23501 discloses a printing apparatus including a gap switching mechanism that holds a printing head in a carriage that slides on a guide rail and that changes the relative distance between the guide rail and the printing head. In the above printing apparatus, by using the gap switching mechanism after appropriately adjusting the position of the guide rail with respect to a main body of the apparatus, the interval, in other words, the gap between the printing medium and the printing head can be adjusted in accordance with the printing medium.

Incidentally, in printing apparatuses, in order to improve the printing quality, the printing head needs to be parallel (or at a fixed angle) to the printing surface of the printing medium. Accordingly, in order to stabilize the position of the carriage, not only a single guide rail but also another member called a side rail in some cases is used, such that the carriage is supported by, other than the guide rail, the side rail as well. However, if the sub-rail is integrally formed with the chassis of the printing apparatus, owing to the processing accuracy of the sub-rail, there are many cases in which an inclination from the parallel state occurs between the printing surface and the printing head. The inclination is referred to as an inclination of the gap. Even if the gap switching mechanism described in Japanese Patent Laid-Open No. 2010-23501 is employed in a printing apparatus including a guide rail and a side rail, since the distances from the printing head to both rails are changed by the same amount, the inclination of the gap cannot be resolved. One method of resolving the inclination of the gap is to fix the sub-rail to the chassis as a member that is capable of being adjusted; however, the position of the sub-rail needs to be adjusted throughout the entire range of movement of the carriage; accordingly, there is an issue such as the adjustment taking time.

SUMMARY OF THE INVENTION

The present disclosure provides a printing apparatus that is capable of facilitating adjustment of an inclination of a gap between a printing head and a printing medium.

The disclosure also provides a printing apparatus including a printing head that performs printing on a printing medium by ejecting ink from the printing head, a carriage on which the printing head is mounted, a first guide rail extending in a first direction that intersects a conveying direction of the printing medium, a second guide rail extending in the first direction, the second guide rail being spaced apart from the first guide rail in the conveying direction, a first guide member that is in contact with the first guide rail and that moves together with the carriage, the first guide member guiding the carriage in the first direction, a second guide member that is in contact with the second guide rail and that moves together with the carriage, the second guide member guiding the carriage in the first direction, an interval switching member provided between the carriage and the first guide member, the interval switching member relatively displacing the carriage with respect to the printing medium in a second direction that is orthogonal to the conveying direction and the first direction, and an inclination control member disposed between either one of the first guide member and the second guide member and the carriage, the inclination control member changing a distance between the carriage and the either one of the first guide member and the second guide member. In the printing apparatus, upon a change in the distance with the inclination control member, the carriage rotates about a guide rail of the first guide rail and the second guide rail that is in contact with the other one of the first guide member and the second guide member, such that an angle of the printing head against the printing medium is changed.

Further features and aspects of the disclosure will become apparent from the following description of numerous example embodiments with reference to the attached drawings.

DESCRIPTION OF THE EXAMPLE EMBODIMENTS

First Example Embodiment

Figure 1:
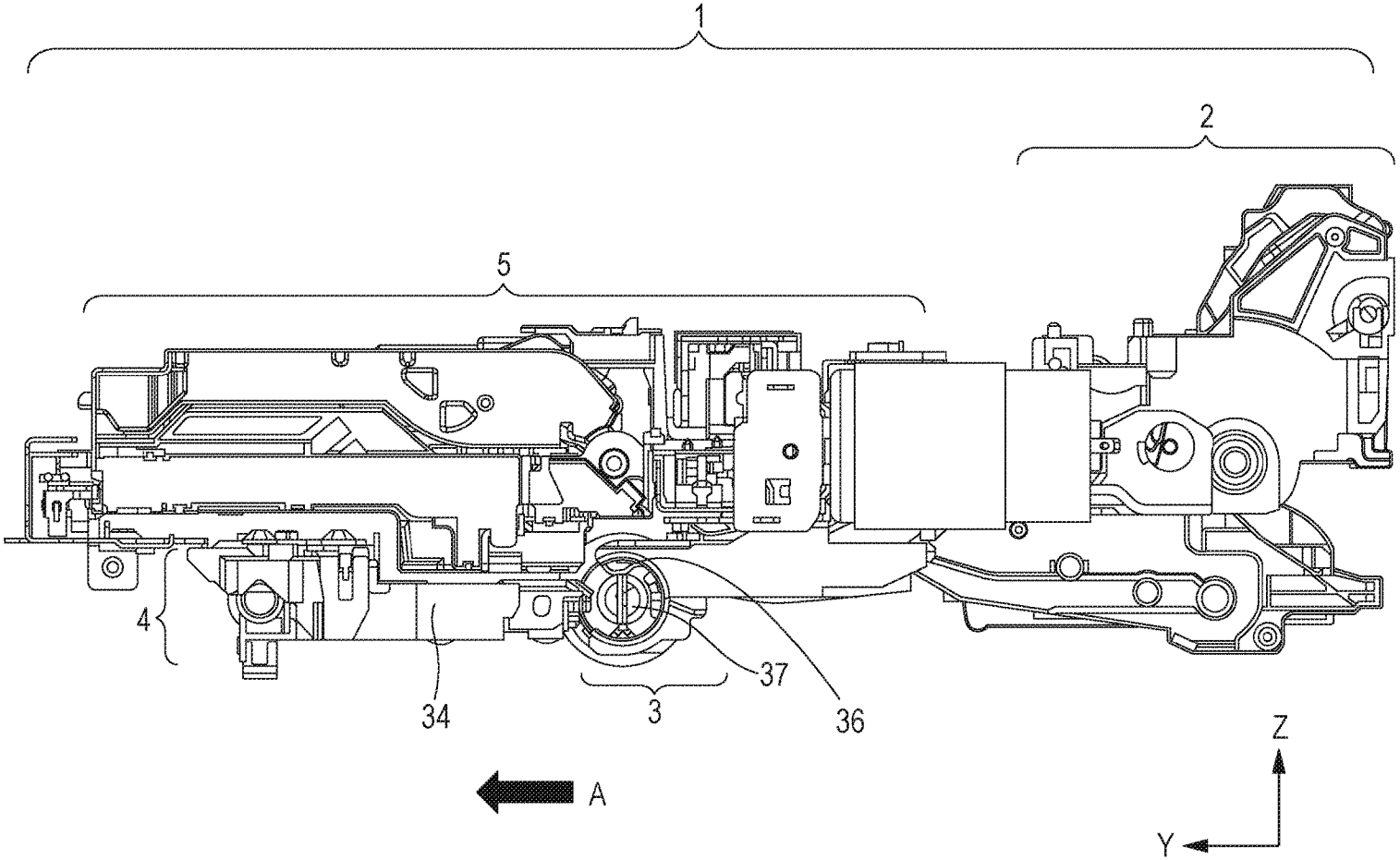
FIG. 1 is a diagram illustrating a printing apparatus of a first example embodiment of the present disclosure.
Figure 2A:
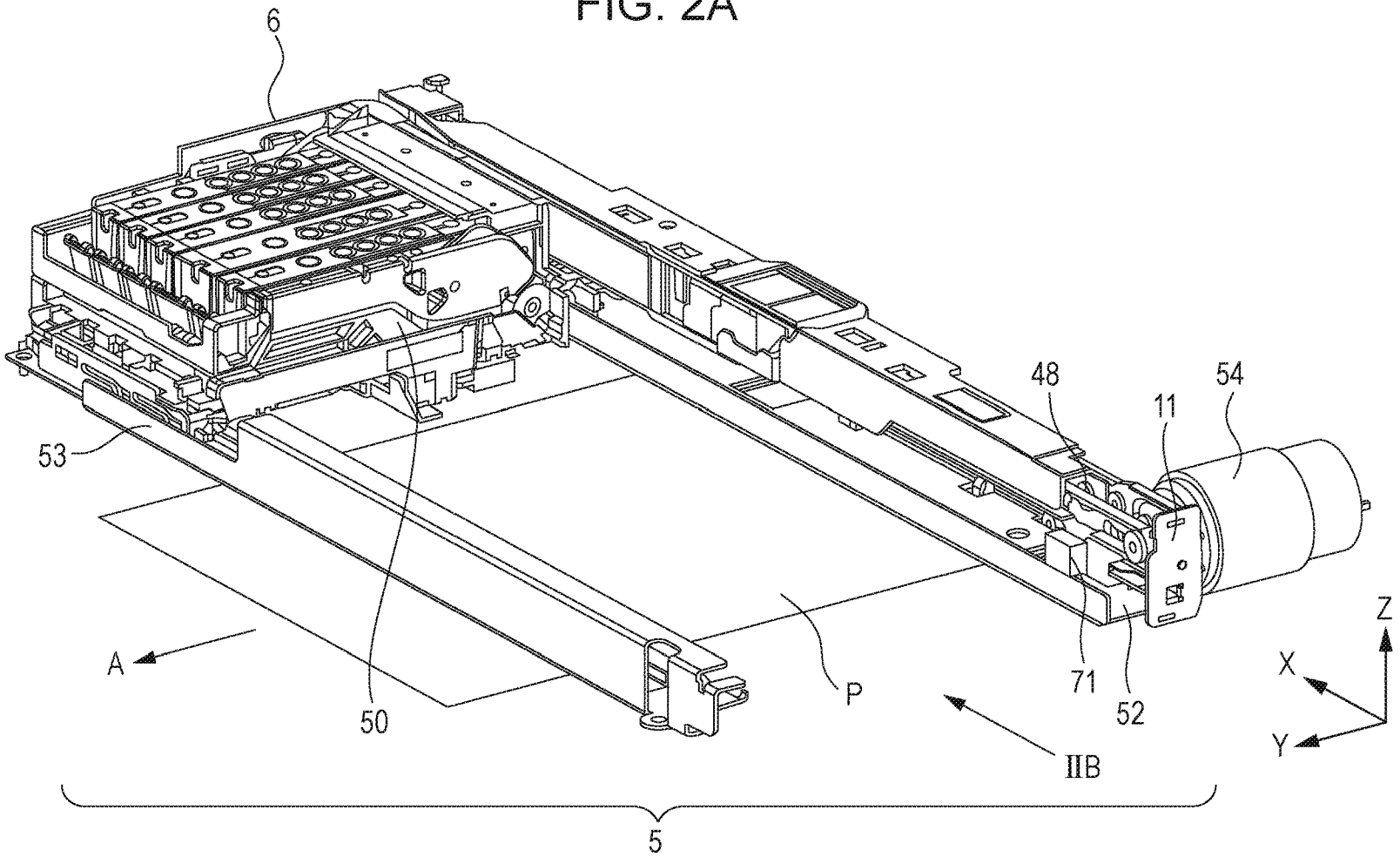
FIGS. 2A and 2B are diagrams illustrating the printing unit according to the printing apparatus of the first example embodiment.
Figure 2B:
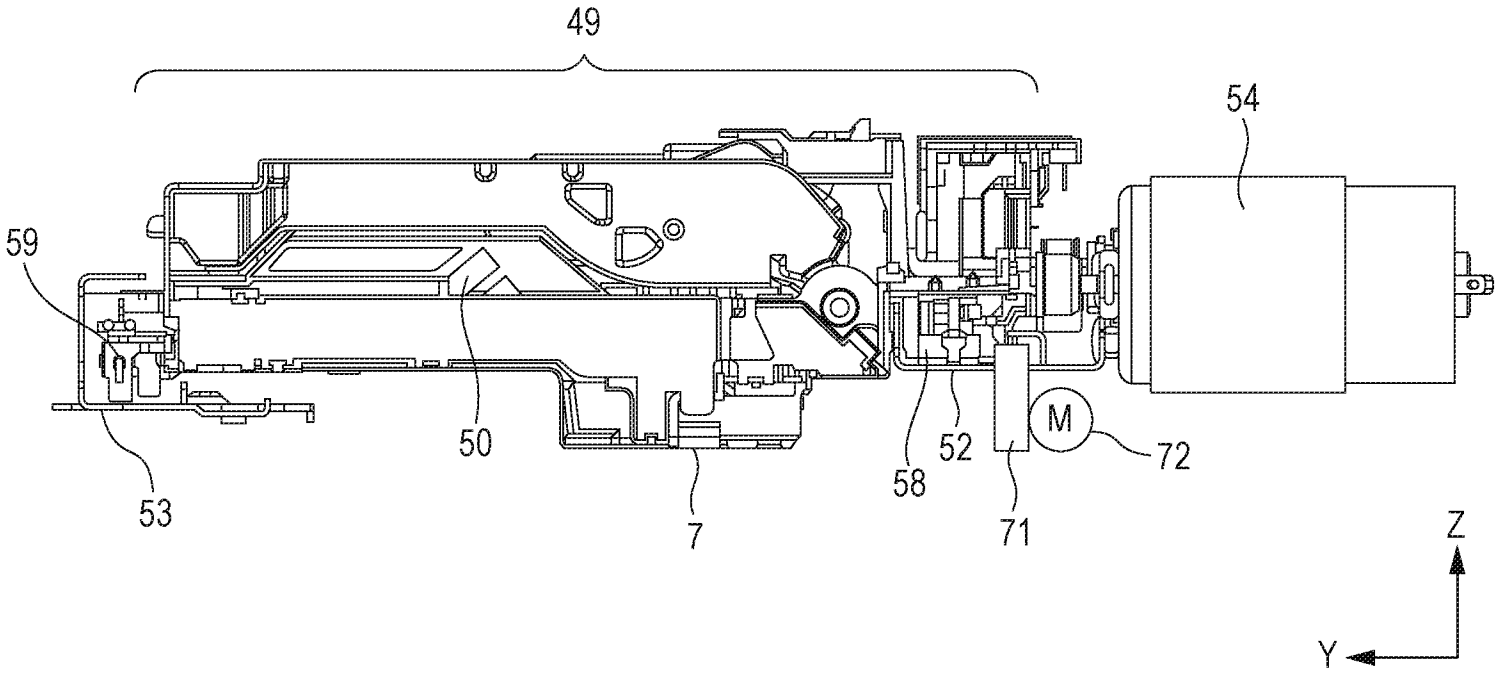

FIG. 1 is a side view of a printing apparatus 1 of a first example embodiment of the present disclosure. The printing apparatus 1, roughly divided, includes a feeding unit 2, a conveyance unit 3, a discharge unit 4, a printing unit 5, and a control unit 6 (see FIG. 2A). The printing unit 5 performs printing by ejecting ink onto a printing medium P. The feeding unit 2 holds the printing medium P on which printing is to be performed, and sends out the printing medium P towards a platen 34 that is provided so as to face the printing unit 5 and that supports the printing medium P that is being printed. The conveyance unit 3 conveys the printing medium P from the feeding unit 2 towards the platen 34. The discharge unit 4 discharges the printing medium P on which printing has been performed to the outside of the printing apparatus 1. In the description hereinafter, a conveying direction of the printing medium P (the direction illustrated by an arrow A in the diagram) is referred to as a Y direction, a direction orthogonal to the Y direction and parallel to a moving direction of a carriage 50 is referred to as an X direction, and a direction that is perpendicular to the X direction and the Y direction is referred to as a Z direction. The Z direction coincides with a normal line of a printing surface of the printing medium P at a position where printing is performed with the printing unit 5. FIGS. 2A and 2B illustrate the printing unit 5 according to the first example embodiment. FIG. 2A is a perspective view, and FIG. 2B is a diagram of the printing unit 5 viewed in an arrow IIB direction in FIG. 2A. However, a chassis 11 is not illustrated in FIG. 2B. The printing unit 5 includes a carriage unit 49, and the carriage unit 49 includes the carriage 50 on which a printing head 7 is detachably mounted.

In the printing apparatus 1, a sheet-shaped printing medium (a sheet) P is conveyed in the arrow A direction (the conveying direction) with the feeding unit 2, and is conveyed on the platen 34 in FIG. 1 along the platen 34. In order to enable the carriage 50 to move reciprocally by moving the carriage 50 in a first direction that intersects the conveying direction A, in the printing unit 5, a first guide rail 52 and a second guide rail 53 that are parallel to each other are fixed to the printing apparatus 1 so as to be disposed across the platen 34. In other words, the first guide rail 52 and the second guide rail 53 are fixed on the two sides of the printing head 7 such that the printing head 7 is interposed therebetween in the conveying direction A. In the example described herein, the first direction (the moving direction) is a direction orthogonal to the conveying direction A and, accordingly, is the X direction. Furthermore, a second direction that is orthogonal to the first direction and the conveying direction is the Z direction. The first guide rail 52 that guides the motion of the carriage 50 in the moving direction (the X direction) is L-shaped, and determines the position of the carriage 50 in the Y direction and the Z direction. Furthermore, a first guide member 58 that is in contact with the first guide rail 52, and a second guide member 59 that is in contact with the second guide rail 53 are attached to the carriage 50 so that the position of the carriage 50 is stable in the conveying direction (the Y direction). In the example illustrated herein, the guide members 58 and 59 slide against the guide rails 52 and 53, respectively, and move integrally with the carriage 50. The guide members 58 and 59 are provided in the carriage 50 so as to be displaceable in a direction orthogonal to the printing surface of the printing medium P that has been conveyed to a position opposing the carriage 50 (in other words, the Z direction). An urging member (not shown) that biases the carriage 50 in a −Y direction is provided on the carriage 50, and the position of the carriage 50 is made stable by holding the first guide rail 52 between the carriage 50 and the urging member with the biasing force. In the ±Z direction illustrated in the diagram, in other words, in the up-down direction, the carriage 50 abuts against the L-shaped first guide rail 52 with its own weight with the first guide member 58 interposed therebetween, and abuts against the second guide rail 53 with the second guide member 59 interposed therebetween; accordingly, the position of the carriage 50 is made stable.

The first guide rail 52 is attached to the chassis 11. Furthermore, the carriage 50 is, through a timing belt 48, driven with a carriage motor 54 attached to the chassis 11. The carriage motor 54 is controlled and driven with the control unit 6. Furthermore, a code strip (not shown) on which a marking at a linear density of 150 to 300 lines per 25.4 mm (1 inch) is provided parallel to the timing belt 48 so as to detect the position of the carriage 50. The carriage 50 is provided with an encoder sensor (not shown) that reads the code strip, and the detection result of the encoder sensor is supplied to the control unit 6.

In the configuration described above, when printing is performed by ejecting ink on the printing medium P, a pair of rollers 36 and 37 (see FIG. 1) convey the printing medium P to a line position (a position along the conveying direction of the printing medium P) that is a position where the printing is performed. Together with the above, the carriage 50 is moved with the carriage motor 54 to a row position (a position along the moving direction of the carriage 50) where printing is performed, such that the printing head 7 opposes the printing position. Subsequently, the printing head 7 ejects ink towards the printing medium P on the basis of a signal from the control unit 6, such that printing is performed.

First interval switching members 55 described later that abut against abutment members 71 are provided in the first guide rail 52 in the range of movement of the carriage unit 49. The abutment members 71 are capable of being moved in the Z direction, illustrated in the diagram, with a driving source 72 so as to be switched between a position abutting against and a position not abutting against the first interval switching members 55. The driving source 72 includes a linear actuator and is controlled and driven by the control unit 6.

Figure 3A:
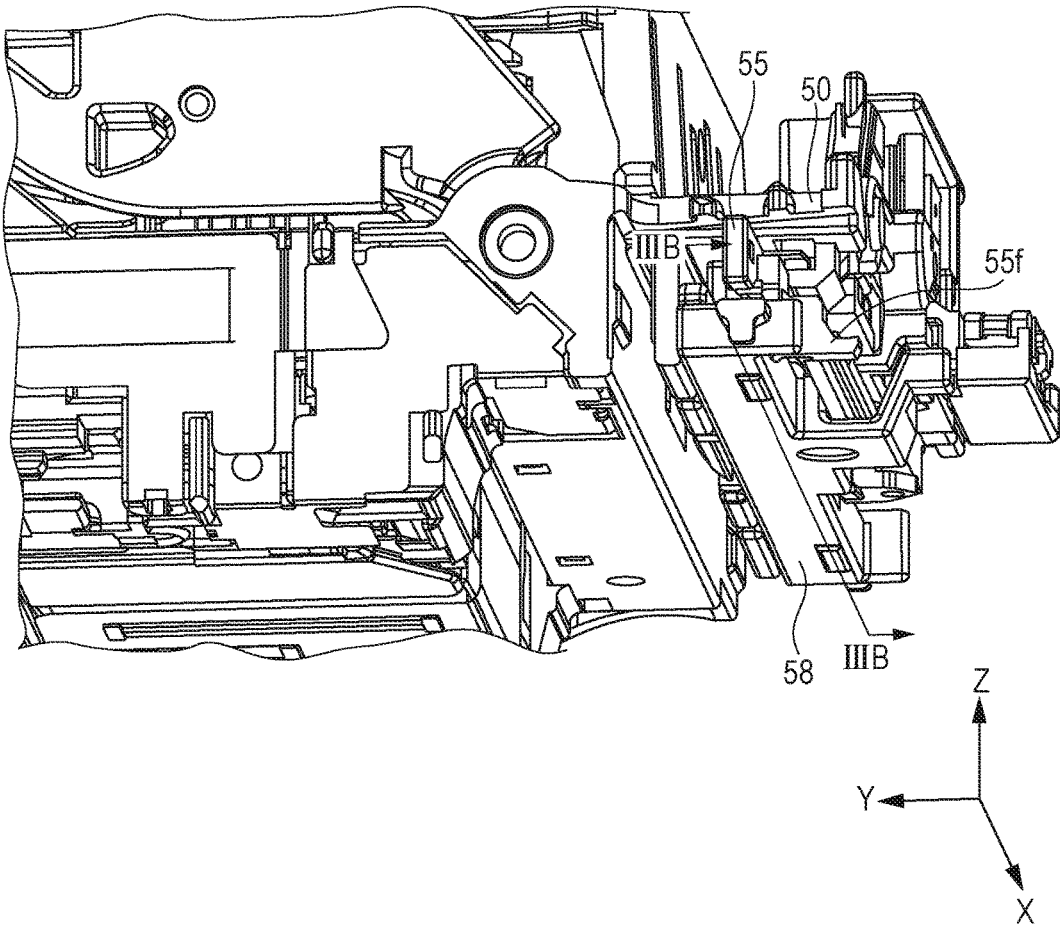
FIGS. 3A and 3B are diagrams for describing a gap switching mechanism.
Figure 3B:
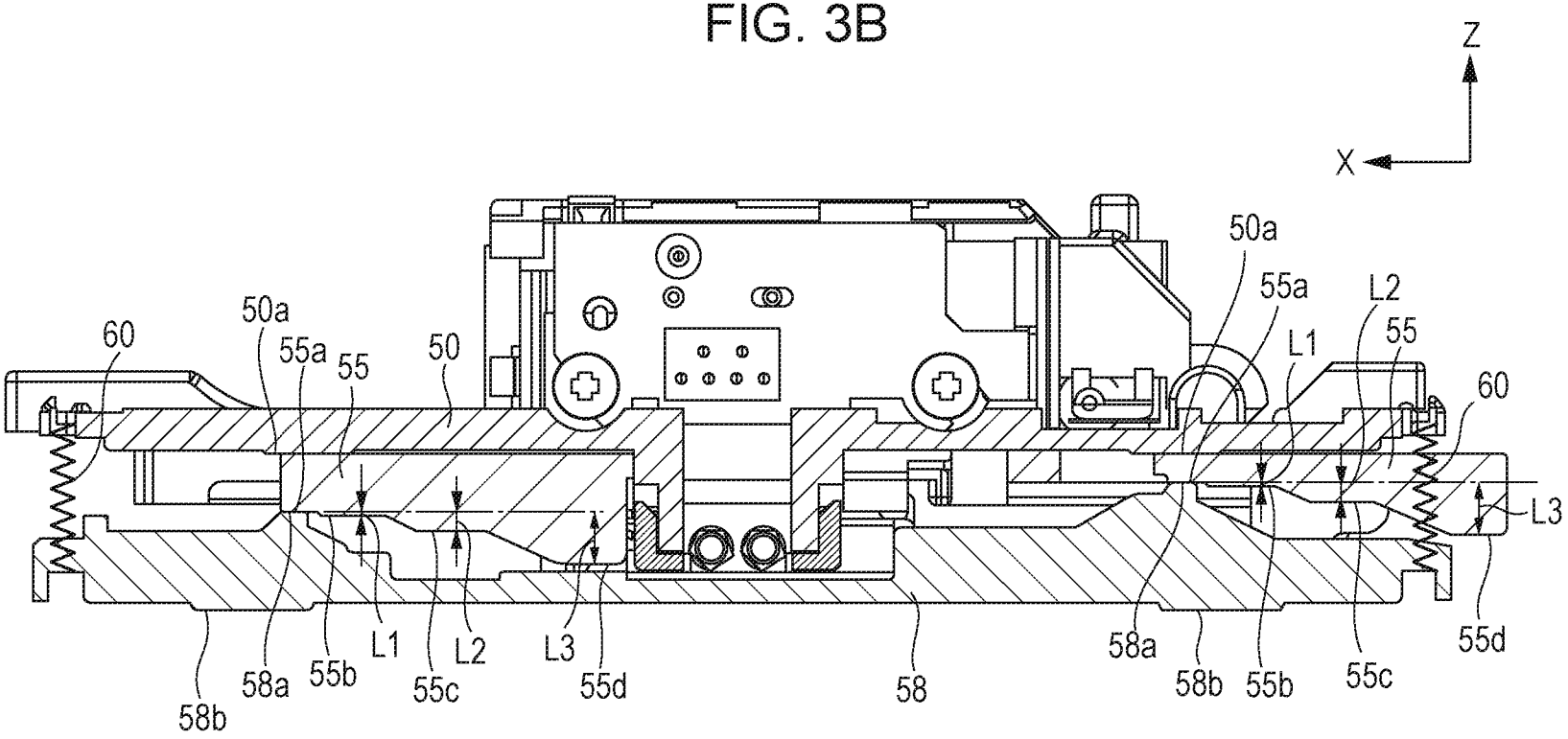
Figure 4A:
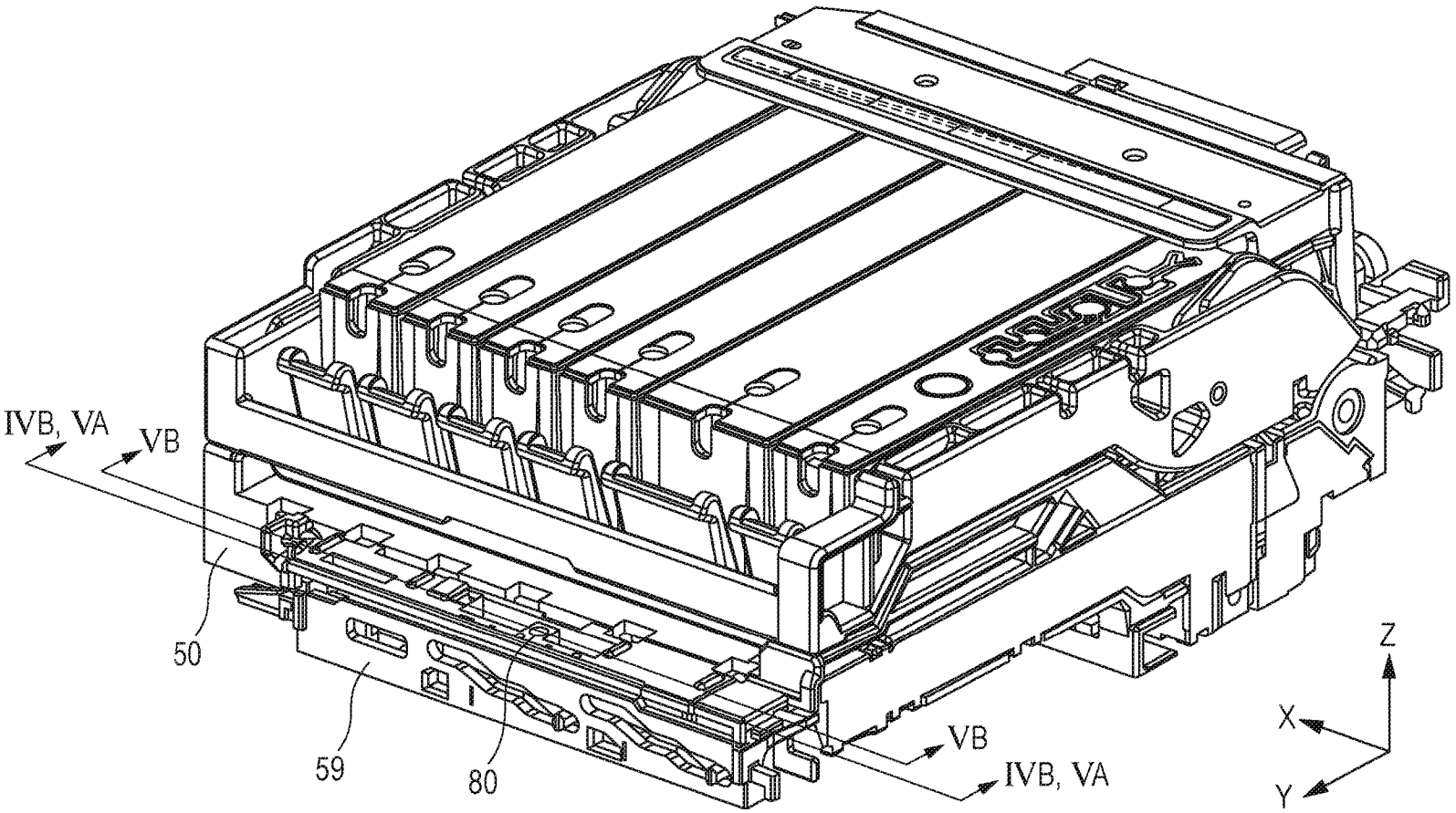
FIGS. 4A and 4B are diagrams for describing the gap switching mechanism.
Figure 4B:
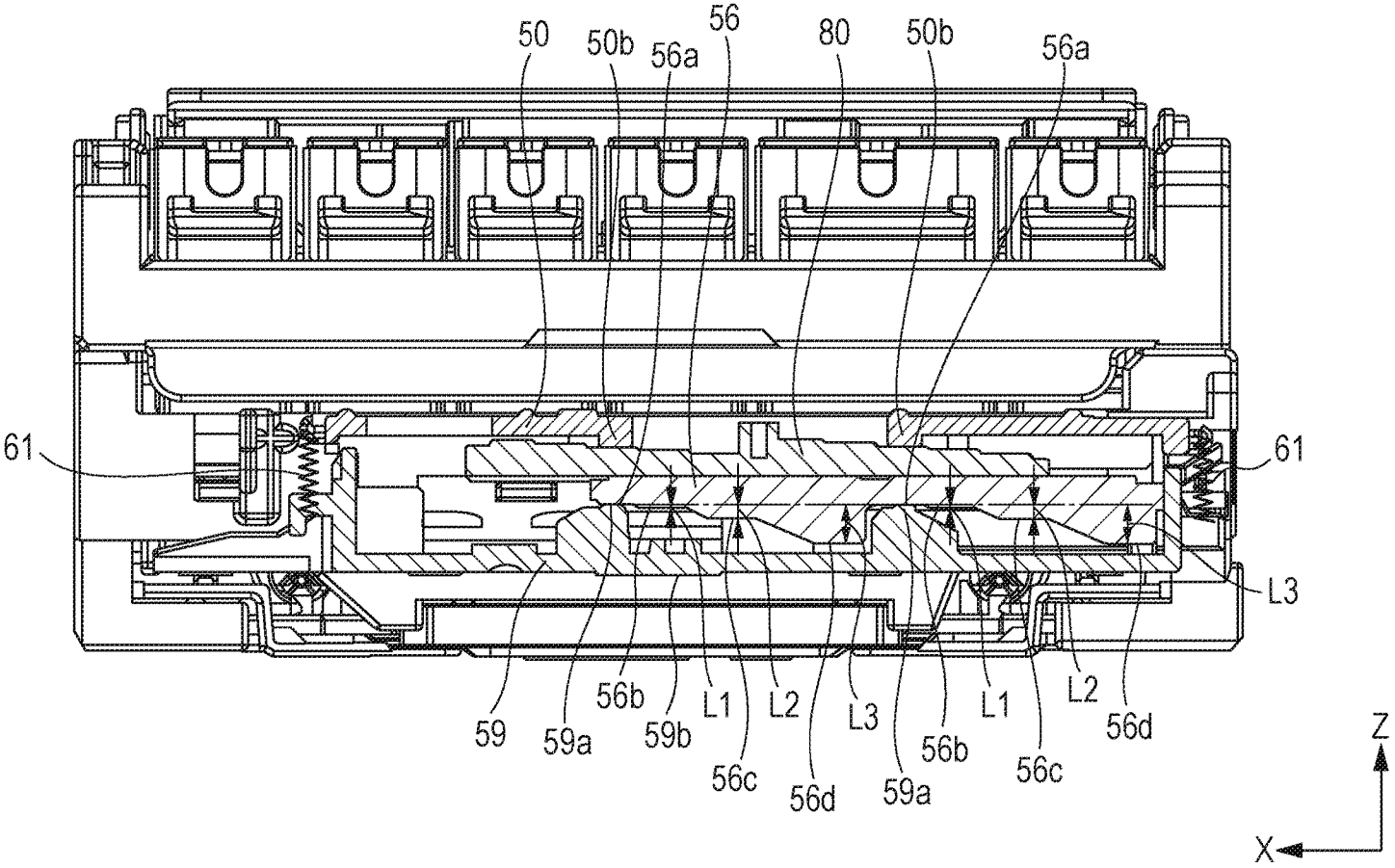

A specific configuration that switches the gap between the printing head 7 and the printing medium P with the guide members 58 and 59 according to the present example embodiment will be described next with reference to FIGS. 3A to 4B. FIG. 3A is a diagram of a vicinity of a sliding portion between the carriage unit 49 and the first guide member 58 viewed from under, and FIG. 3B is a cross-sectional view taken along line IIIB-IIIB in FIG. 3A. FIG. 4A is a diagram of a vicinity of a sliding portion between the carriage unit 49 and the second guide member 59 viewed from above, and FIG. 4B is a cross-sectional view taken along line IVB-IVB in FIG. 4A.

The first guide member 58 is locked to the carriage 50 with positioning members (not shown) so as to be movable in only the Z direction. The first guide member 58 is abutted against the first guide rail 52 Z direction through the sliding portions 58*b* of the first guide member 58 with the weight of the carriage unit 49 itself, such that when the carriage unit 49 moves in the X direction, the first guide member 58 slides against the first guide rail 52. The first interval switching members 55 are locked with positioning members (not shown) so as to be movable in only the Y direction between the first guide member 58 and the carriage 50. The first guide member 58 is biased in the +Z direction against the carriage 50 with first urging members 60, such as springs, and abutment portions 58*a* thereof abuts against abutment portions 55*a* on the first interval switching members 55. Furthermore, the first interval switching members 55 are biased in the +Z direction through the first guide member 58 with the first urging members 60, such that the first switching members 55 abut against abutment surfaces 50*a* of the carriage 50. By having the first interval switching members 55 move in the +X direction, the surfaces that the abutment portions 58*a* of the first guide member 58 abut against the first interval switching members 55 change from the abutment portions 55*a* to abutment portions 55*h*. The abutment portions 55*a* and 55*b* are both surfaces perpendicular to the Z direction, and the distance therebetween in the Z direction is set to L1. Change in the surfaces against which the abutment portions 58*a* of the first guide member 58 abut increases the distance between the first guide member 58 and the abutment surfaces 50*a* of the carriage 50 in the Z direction by L1. The first interval switching members 55 further include abutment portions 55*c* and 55*d* that are similar to the abutment portions 55*a* and 55*h*. The distance between the abutment portions 55*a* and the abutment portions 55*c* in the Z direction is L2, the distance between the abutment portions 55*a* and the abutment portions 55*d* in the Z direction is L3, and a relationship L3>L2>L1 holds true. Accordingly, change in the surfaces against which the abutment portions 58*a* of the first guide member 58 abut from the abutment portions 55*a* to the abutment portions 55*c* or 55*d* increases the distance between the first guide member 58 and the abutment surfaces 50*a* of the carriage 50 in the Z direction by L2 or L3.

Projection portions 55*f* that project in the direction are formed in the first interval switching members 55, so as to be capable of abutting against the abutment members 71, which are in an abutted state, when the carriage unit 49 is moved in the X direction. By having the projection portions 55*f* abut against the abutment members 71 when the carriage unit 49 is moving in the X direction, the relative positions of the first interval switching members 55 with respect to the first guide member 58 in the X direction change. Accordingly, change in the surfaces against which the abutment portions 58*a* of the first guide member 58 abut can be made between the abutment portions 55*a*, 55*b*, 55*c*, and 55*d*.

In a similar manner, the second guide member 59 is locked to the carriage 50 with a positioning member (not shown) so as to be moveable in only the Z direction. The second guide member 59 is abutted against the second guide rail 53 in the Z direction through the sliding portion 59*b* of the second guide member 59 with the weight of the carriage unit 49 itself, such that when the carriage unit 49 moves in the X direction, the second guide member 59 slides against the second guide rail 53. Furthermore, a second interval switching member 56 is locked with a positioning member (not shown) so as to be movable in only the Y direction between the second guide member 59 and the carriage 50. The second guide member 59 is biased in the +Z direction against the carriage 50 with second urging members 61, such as springs, and abutment portions 59*a* thereof abuts against abutment portions 56*a* on the second interval switching member 56. The second interval switching member 56 is biased in the +Z direction through the second guide member 59 with the second urging members 61, such that the second interval switching member 56 abuts against an inclination control member 80 described later. Similar to the first interval switching members 55, the second interval switching member 56 includes abutment portions 56*a*, 56*b*, 56*c*, and 56*d* that are each a surface perpendicular to the Z direction. The distances from the abutment portions 56*a* to the abutment portions 56*h*, 56*c*, and 56*d* in the Z direction are L1, L2, and L3, respectively, and a relationship of L3>L2>L1 holds true. By having the second interval switching member 56 move in the +X direction, the surfaces that the abutment portions 59*a* of the second guide member 59 abut against the interval switching member 56 change from the abutment portions 56*a* to abutment portions 56*b*. With the above, the distance between the second guide member 59 and the inclination control member 80 in the Z direction increases by L1. Moreover, change in the surface against with the abutment portions 59*a* of the second guide member 59 abut from the abutment portions 56*a* to the abutment portions 56*c* or 56*d*, the distance between the second guide member 59 and the inclination control member 80 in the Z direction increases by L2 or L3.

The first interval switching members 55 and the second interval switching member 56 may be mechanically connected inside the carriage unit 49, and the second interval switching member 56 may be slid in the X direction interlocking with the first interval switching member 55 abutting against the abutment member 71. Alternatively, the second interval switching member 56 may also be provided with projection portions, and abutment members, which can be controlled by the control unit 6, other than the abutment members 71 may be provided. The second interval switching member 56 may be slid by abutting the projection portions against the abutment member. In a case in which projection portions are provided in the second interval switching member 56 as well, the first interval switching members 55 and the second interval switching member 56 may slid in the X direction at the same time or with a time difference. In either case, the amount of adjustment of distance with the first interval switching members 55 in the Z direction, and the amount of adjustment of distance with the second interval switching member 56 in the Z direction are to be, ultimately, the same. With the above, the gap between the printing surface and the printing head. 7 can be changed while keeping the angle of the printing head 7 against the printing surface of the printing medium P substantially the same with the control unit 6 controlling the carriage motor 54 and the driving source 72. Note that while the first interval switching members 55 and the second interval switching member 56 can move the printing head 7 parallelly in the Z direction, an adjustment of the inclination of the gap cannot be made.

Figure 5A:
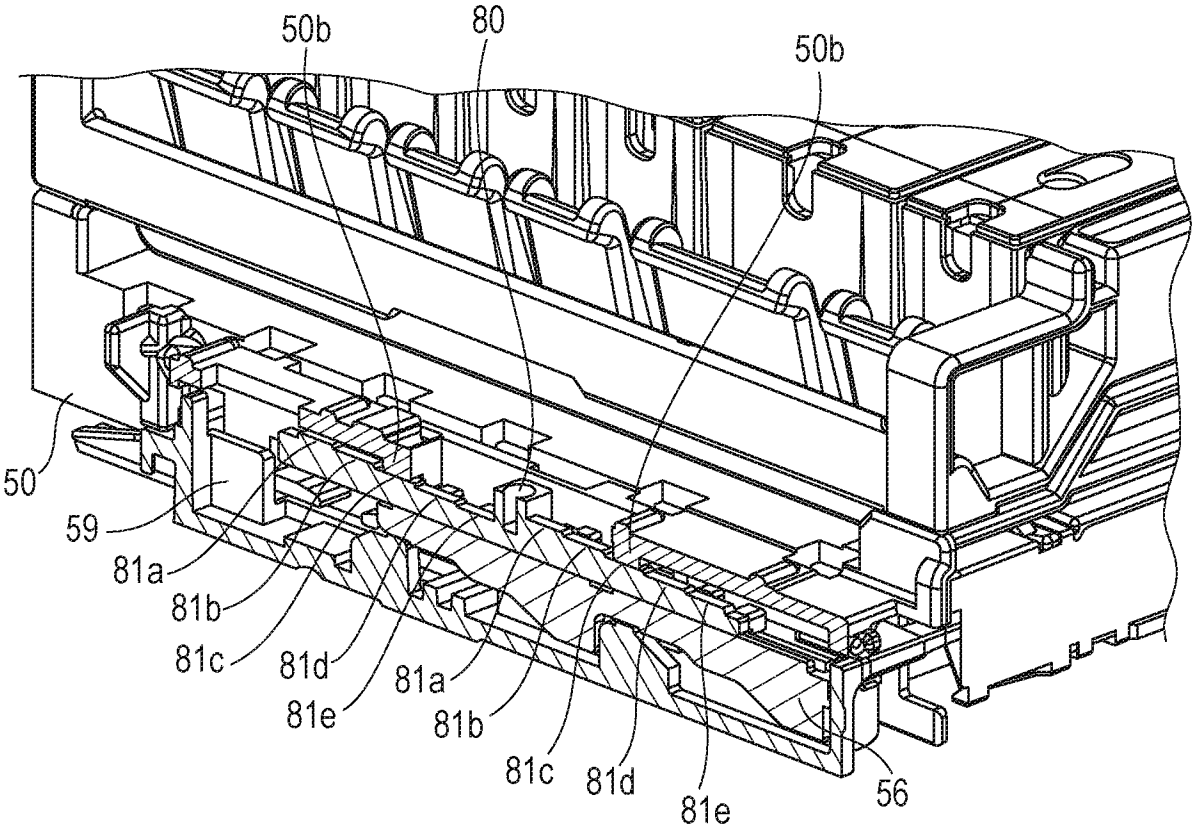
FIGS. 5A and 5B are diagrams for describing a mechanism that adjusts an inclination of a gap.
Figure 5B:
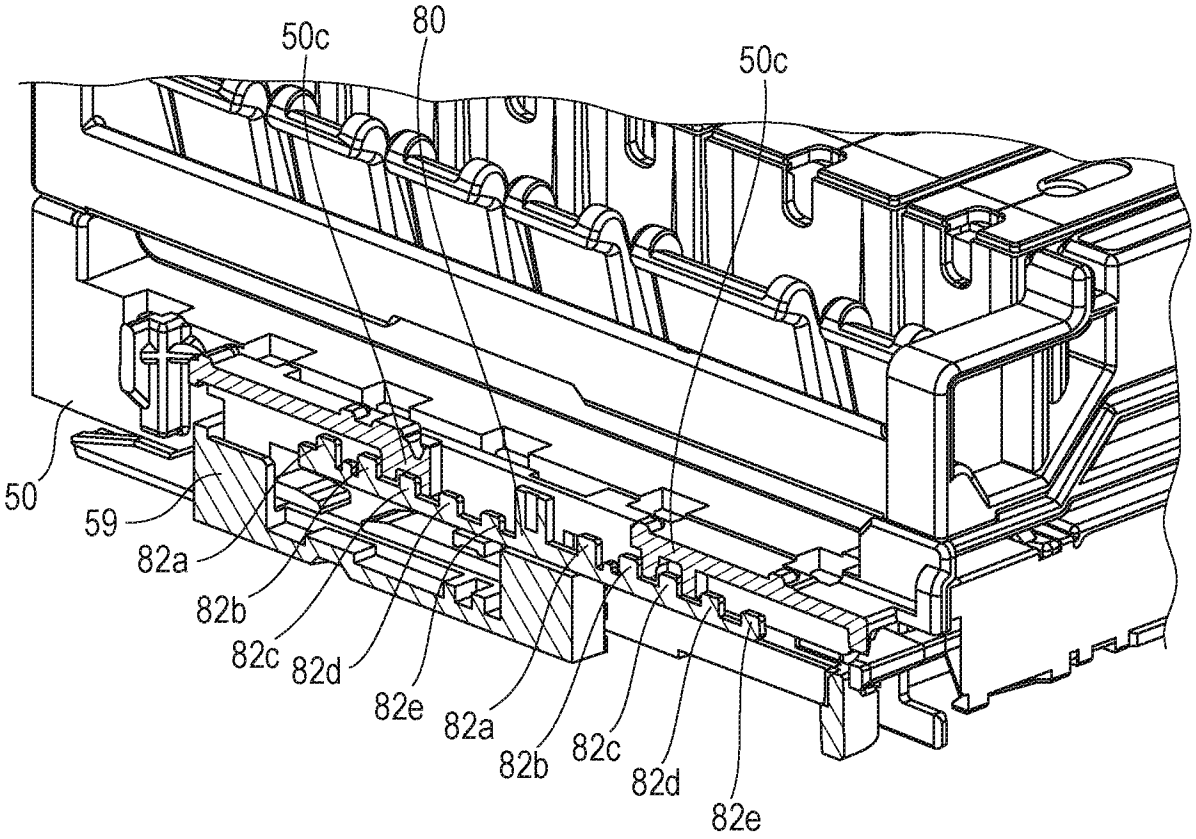

A mechanism that adjusts the gap and the inclination according to the present example embodiment will be described next with reference to FIGS. 4A to 5B. FIG. 5A is a perspective view of the carriage unit 49 cut along a plane that includes line VA-VA in FIG. 4A and that is perpendicular to the Y direction, and FIG. 5B is a perspective view of the carriage unit 49 cut along a plane that includes line VB-VB in FIG. 4A and that is perpendicular to the Y direction. As illustrated in FIG. 4A and as described above, the carriage unit 49 is provided with the inclination control member 80. The inclination control member 80 is interposed between the carriage 50 and the second guide member 59 in the Z direction. The inclination control member 80 has a shape elongated in the X direction, and includes a bottom surface that is perpendicular to the Z direction, and an upper surface including a plurality of flat surface portions that are perpendicular to the Z direction. The plurality of flat surface portions constitute inclination control portions 81*a*, 81*b*, 81*c*, 81*d*, and 81*e*. The inclination control portions 81*a*, 81*b*, 81*c*, 81*d*, and 81*e* are arranged in the X direction, and the distance between each inclination control portion and the bottom surface is different in each inclination control portion. In other words, the thickness of the inclination control member 80 in the Z direction is different depending on the position of the inclination control member 80 in the X direction. Herein, while the inclination control portions 81*a* to 81*e* are provided in five levels, it is only sufficient that the number of inclination control portions are plural and the number is not limited to five. Herein, the distances between the inclination control portion 81*a*, and the inclination control portions 81*b*, 81*c*, 81*d*, and 81*e* in the Z direction are set to W1, W2, W3, and W4, respectively. Herein, W4>W3>W2>W1 is satisfied. In the illustrated diagram, a configuration formed of the inclination control portions 81*a* to 81*e* in five levels are provided in the inclination control member 80 at two locations in the X direction.

The inclination control member 80 is biased in the H-Z direction with the second urging members 61 through the second guide member 59 and the second interval switching member 56. With the above, the inclination control portions 81*a* of the inclination control member 80 abut against the abutment surfaces 50*b* of the carriage 50. By moving the inclination control member 80 in the +X direction, the portions in the inclination control member 80 where the abutment surfaces 50*b* of the carriage 50 abut against moves to the inclination control portions 81*h*. As a result, the distance between the second interval switching member 56 and the abutment surfaces 50*a* of the carriage 50 in the Z direction decreases by W1. In a similar manner, when the positions where the abutment surfaces 50*b* of the carriage 50 abut against changes from the inclination control portions 81*a* to the inclination control portions 81*c*, 81*d*, or 81*e*, the distances between the second interval switching member 56 and the abutment surfaces 50*a* of the carriage 50 in the Z direction decreases by W2, W3, or W4. In the above configuration, while the interval between the carriage 50 and the second guide member 59 changes, the interval between the carriage 50 and the first guide member 58 does not change. Accordingly, when the interval between the carriage 50 and the second guide member 59 is changed with the sliding operation of the inclination control member 80, the carriage 50 is slightly rotated about the first guide rail 52 serving as a central axis. With the above, the angle of the printing head 7 against the printing medium P can be changed, and an adjustment of the inclination of the gap between the printing head 7 mounted in the carriage 50 and the platen 34 can be adjusted.

In the present example embodiment, when performing a gap switching operation described above in accordance with the type and the like of the printing medium, the inclination control member 80 does not relatively move with respect to the carriage 50. In other words, when performing ejection of ink to the printing medium P, the inclination of the gap does not automatically change with the control of the control unit 6. Furthermore, position restriction portions 82*a*, 82*h*, 82*c*, 82*d*, and 82*e* that restrict the inclination control member 80 from moving relatively in the X direction (the direction in which the inclination control member 80 changes the inclination of the gap) with respect to the carriage 50 are provided in the inclination control member 80. The position restriction portions 82*a*, 82*b*, 82*c*, 82*d*, and 82*e* correspond to the inclination control portions 81*a*, 81*b*, 81*c*, 81*d*, and 81*e*, respectively, and are formed as projections oriented in the Z direction, for example. The position restriction portions 82*a*, 82*b*, 82*c*, 82*d*, and 82*e* are each capable of engaging with the corresponding recessed position restriction portion 50*c* provided in the carriage 50. By having either of the position restriction portions 82*a*, 82*b*, 82*c*, 82*d*, and 82*e* engage with the corresponding position restriction portion 50*c* on the carriage 50 side, the inclination control member 80 is restricted from moving in the X direction.

In the above engaged state, by moving the inclination control member 80 in a direction (the Y direction, for example) different from the direction that changes the inclination of the gap, the engaged state can be cancelled. Accordingly, by first moving the inclination control member 80 in the direction cancelling the engaged state and then moving the inclination control member 80 in the direction changing the inclination of the gap, the state in which the gap is inclined can be changed, and an adjustment of the inclination of the gap can be made. Specifically, the engagement with the position restriction portion 50*c* on the carriage 50 side is released by pressing the inclination control member 80 with a finger or the like and, then, the inclination control member 80 is slid in the X direction so that the inclination of the gap is set to the desired inclination; accordingly, adjustment of the inclination of the gap can be performed. The adjustment of the inclination of the gap is performed, for example, when shipping, or when the positional relationship between the first guide rail 52 and the second guide rail 53 has changed due to degradation with time. Furthermore, the carriage 50 includes a biasing member that biases the inclination control member 80 so that the state in which the engagement of the inclination control member 80 to the position restriction portion 50*c* is cancelled is set to an engaged state once more. The second urging members 61 that bias the second guide member 59 against the carriage 50 may be used as the above biasing member as well, or a member provided separately may be used. By providing such a biasing member, unintended cancellation of the engaged state can be prevented and the engaged state can be cancelled easily when adjustment of the inclination of the gap is performed.

As described above, in the printing apparatus of the present example embodiment, the adjustment of the Inclination of the gap can be facilitated with a simple configuration. Herein, while the inclination control member 80 is interposed between the carriage 50 and the second guide member 59 in the Z direction, in other words, in the direction that is substantially orthogonal to the printing surface of the printing medium P, the position of the inclination control member 80 is not limited to the above. For example, the inclination control member 80 may be interposed between the carriage 50 and the first guide member 58. In short, it is only sufficient that the inclination control member 80 is provided at a position that enables the distance in the Z direction between either one of the first and second guide rails 52 and 53 and the carriage 50 to be changed.

Second Example Embodiment

Figure 6A:
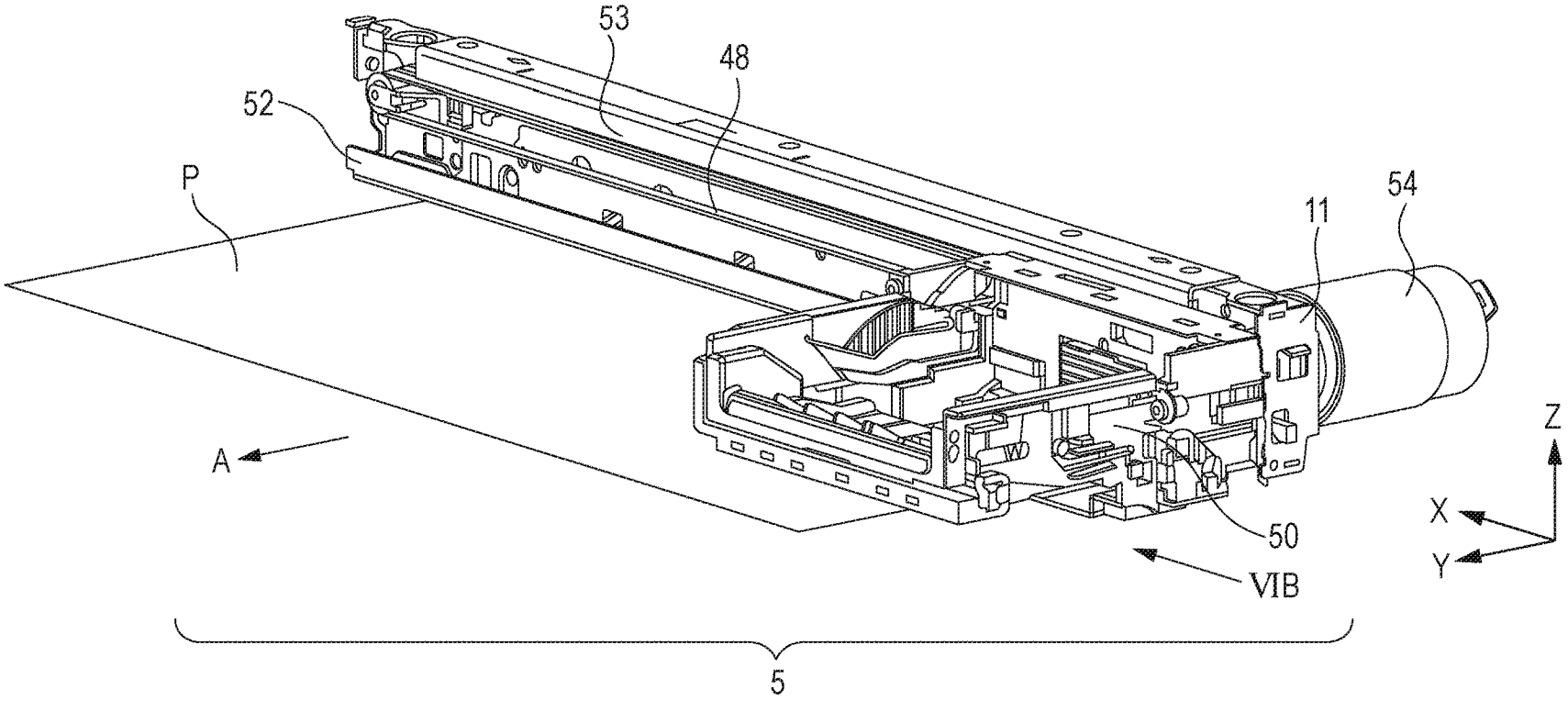
FIGS. 6A to 6C are diagrams illustrating a printing unit according to a printing apparatus of a second example embodiment.
Figure 6B:
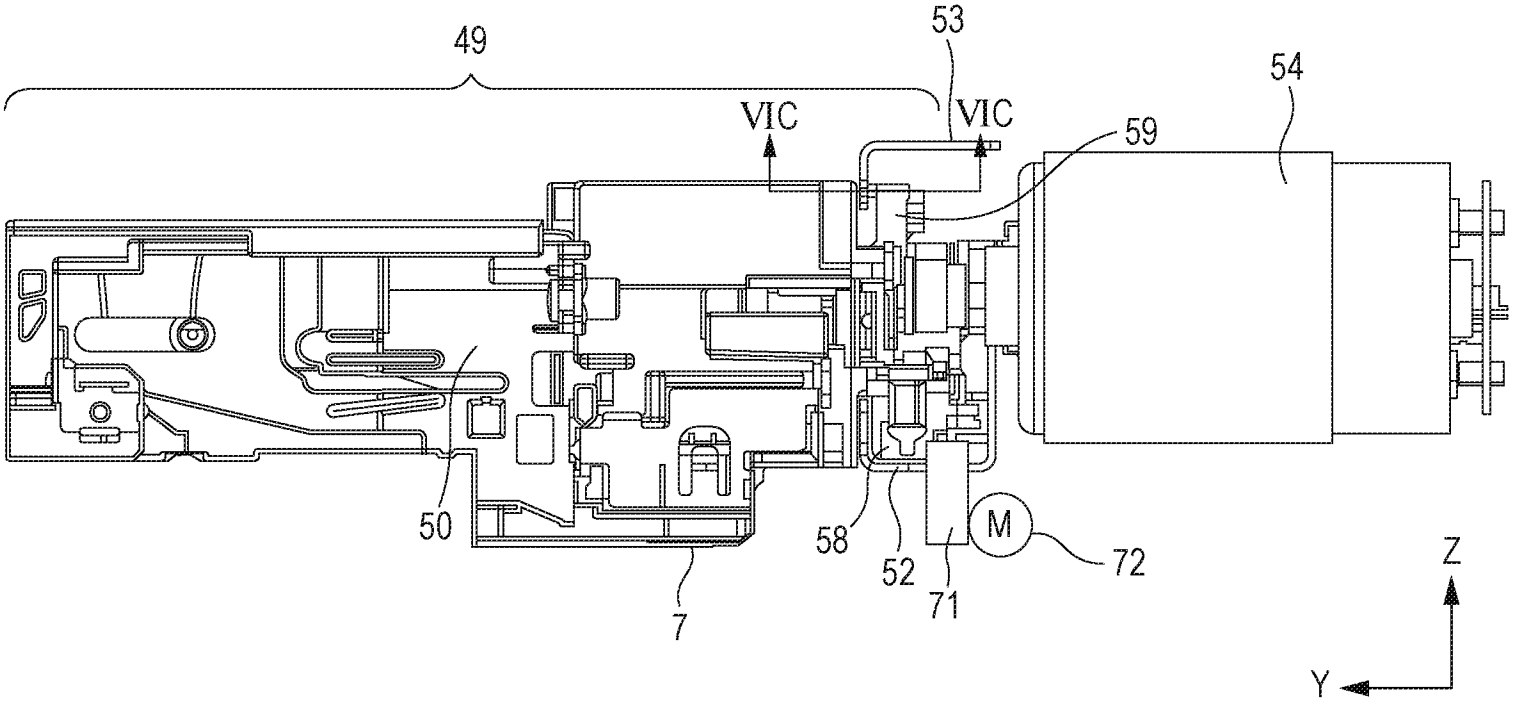
Figure 6C:
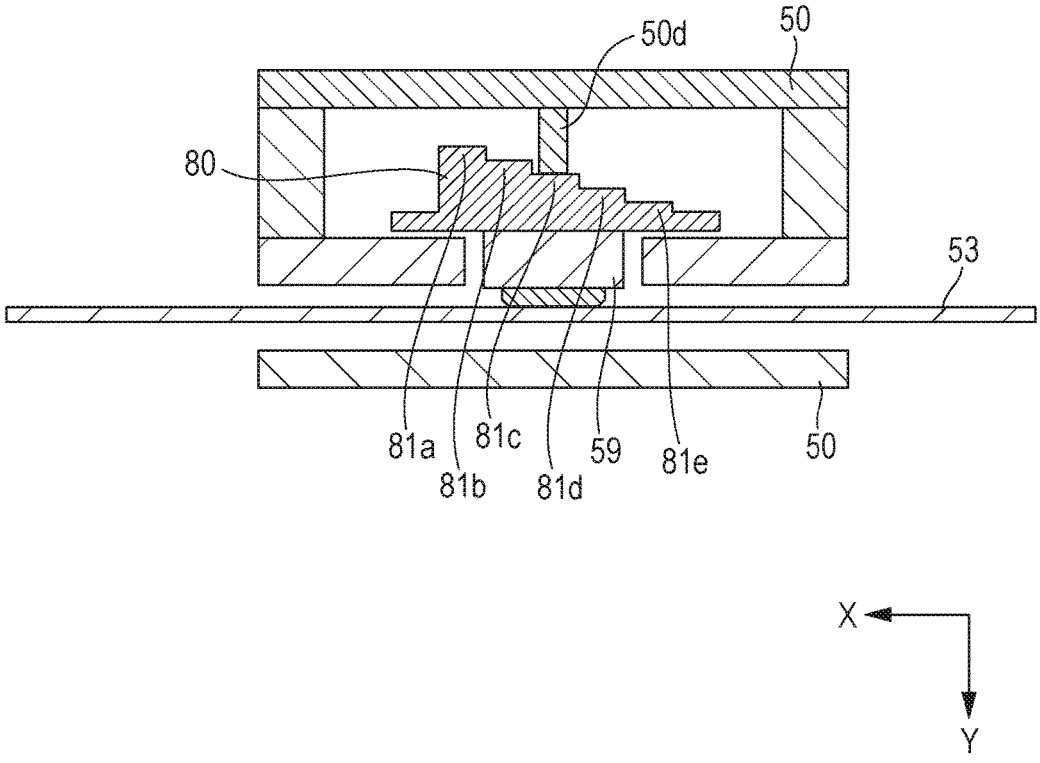

FIG. 6A is a perspective view of a printing unit 5 of a printing apparatus according to a second example embodiment of the present disclosure, FIG. 6E is a diagram of the printing unit 5 viewed from a VIE direction in FIG. 6A, and FIG. 6C is a cross-sectional view taken along line VIC-VIC in FIG. 6B. In FIG. 6B, the chassis 11 is not depicted. In order to maintain the position of the carriage 50, two guide rails 52 and 53 are needed. In the first example embodiment described above, the first and second guide rails 52 and 53 are fixed to the printing apparatus so as to be disposed across the platen in a conveying direction A of the printing medium P. However, the positional relationship between the guide rails 52 and 53 is not limited to the positional relationship described in the first example embodiment. In the printing apparatus of the second example embodiment illustrated in FIGS. 6A to 6C, viewed from the platen 34, the first and second guide rails 52 and 53 are fixed on the upstream side in the conveying direction A of the printing medium P. Herein, the first and second guide rails 52 and 53 are disposed parallel to each other so as to be spaced apart in the Z direction, in other words, in a direction substantially orthogonal to the printing surface of the printing medium P, and the first guide rail 52 is on the lower side in the gravitational direction. The first guide rail 52 supports the mass of the carriage 50, and by having the center of gravity of the carriage 50 be positioned away from the first guide rail 52, a force couple that causes rotation about the first guide rail 52 is generated. Accordingly, the second guide member 59 is pressed against the second guide rail 53 in the Y direction.

As illustrated in FIG. 6C, the inclination control member 80 is interposed between the carriage 50 and the second guide member 59 in the Y direction. Furthermore, the inclination control member 80 has, similar to the first example embodiment, an elongated shape that extends in the X direction, and includes, on the inclination control member 80, a plurality of inclination control portions 81*a*, 81*b*, 81*c*, 81*d*, and 81*e* that have thicknesses that are different from each other in the Z direction in accordance with the positions thereof in the X direction. The inclination control portions 81*a*, 81*b*, 81*c*, 81*d*, and 81*e* each forms a flat surface portion that is perpendicular to the Z direction. Although not illustrated in FIGS. 6A to 6C, similar to toe first example embodiment, position restriction portions that restrict the inclination control member 80 from moving in the direction in which the inclination of the gap is displaced are provided in the inclination control member 80. In the present example embodiment, a distal end surface of the projection portion 50*d* that protrudes from the carriage 50 in the Y direction is the surface abutting against the inclination control member 80, and similar to the first example embodiment, the above abutment surface abuts against either one of the inclination control portions 81*a*, 81*b*, 81*c*, 81*d*, and 81*e*. The distance between the carriage 50 and the second guide rail 53 in the Y direction changes depending on which inclination control portions 81*a*, 81*b*, 81*c*, 81*d*, and 81*e* the projection portion 50*d* abuts against. The above change in distance causes a slight rotation of the carriage 50 about the first guide rail 52 serving as a central axis, and with such rotation, the inclination of the printing head 7 with respect to the printing surface of the printing medium P changes, such that adjustment of the inclination of the gap can be made.

Although not illustrated in FIGS. 6A to 6C, in the second example embodiment, similar to the first example embodiment, the first internal switching member 55 is provided between the first guide member 58 and the carriage 50. The first interval switching member 55 adjusts the gap between the printing head 7 and the printing medium P. As described above, since only a pressing force in the Y direction mainly acts on the second guide member 59, in the above configuration, there is no need to provide an interval switching member on the second guide member 59 side. However, as another example of the printing apparatus of the second example embodiment, the inclination control member 80 may be provided on the first guide member 58 side. In such a case, after providing the second guide rail 53 such that the movement of the carriage 50 in the Y direction is restricted, the inclination control member 80 is disposed so that the distance between the carriage 50 and the first guide member 58 in the Y direction changes.

In the printing apparatus of the second example embodiment, the configurations other than those described above are practically the same as those of the first example embodiment; accordingly, the corresponding members are denoted with the same reference numerals and detailed description thereof are omitted.

The preferable example embodiments of the present disclosure have been described above. In the present disclosure, the thicknesses of the inclination control portions provided in the inclination control member 80 may be in any number of levels as long as there are a plurality of levels. In the above description, the inclination control member 80 changes the distance between the carriage 50 and the second guide rail 53 when slid in the X direction (in other words, in the moving direction); however, the inclination control member 80 is not limited to such a member. For example, an inclination control member 80 may be used that changes the inclination of the gap by rotating rather than moving in the X direction. In other words, an inclination control member 80 can be used as long as the inclination control member 80 can, by changing the distance between the guide member corresponding to one of the guide rails and the carriage, create a rotating motion in the carriage 50 about the other guide rail serving as a central axis.

As described above, in the present disclosure, by disposing the inclination control member between the carriage and the guide member, the inclination of the gap between the printing head and the printing medium can be adjusted easily.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-149981 filed Jul. 29, 2016, which is hereby incorporated by reference herein in its entirety.

What is claimed is:

1. A printing apparatus comprising:

a printing head that performs printing on a printing medium by ejecting ink from the printing head;

a carriage on which the printing head is mounted;

a first guide rail extending in a first direction that intersects a conveying direction of the printing medium;

a second guide rail extending in the first direction, the second guide rail being spaced apart from the first guide rail in the conveying direction;

a first guide member that is in contact with the first guide rail and that moves together with the carriage, the first guide member guiding the carriage in the first direction;

a second guide member that is in contact with the second guide rail and that moves together with the carriage, the second guide member guiding the carriage in the first direction;

an interval switching member provided between the carriage and the first guide member, the interval switching member relatively displacing the carriage with respect to the printing medium in a second direction that is orthogonal to the conveying direction and the first direction; and an inclination control member disposed between either one of the first guide member and the second guide member and the carriage, the inclination control member changing a distance between the carriage and the either one of the first guide member and the second guide member, wherein upon a change in the distance with the inclination control member, the carriage rotates about a guide rail of the first guide rail and the second guide rail that is in contact with the other one of the first guide member and the second guide member, such that an angle of the printing head against the printing medium is changed.

2. The printing apparatus according to claim 1, wherein the first guide rail and the second guide rail are fixed on the same side with respect to the printing head in the conveying direction.

3. The printing apparatus according to claim 1, wherein the first guide rail and the second guide rail are fixed on both sides of the printing head so as to interpose the printing head therebetween in the conveying direction, and wherein a second interval switching member is provided between the carriage and the second guide member as well.

4. The printing apparatus according to claim 1, wherein the inclination control member includes a bottom surface, and an upper surface formed of a plurality of flat surface portions parallel to the bottom surface, a thickness of the inclination control member being different at portions corresponding to the plurality of flat surface portions.

5. The printing apparatus according to claim 4, wherein the carriage includes an abutment surface that abuts against the upper surface of the inclination control member, and wherein the bottom surface of the inclination control member is in contact with either one of the first guide member and the second guide member, and the interval switching member, and is movable in the first direction with respect to the either one of the first guide member and the second guide member.

6. The printing apparatus according to claim 5, further comprising:

a position restriction portion that engages with the inclination control member so as to restrict a movement of the inclination control member in the first direction.

7. The printing apparatus according to claim 6, wherein the inclination control member is movable in a direction different from the first direction so as to cancel an engaged state with the position restriction portion, and wherein the printing apparatus further includes a biasing member that biases the inclination control member to an engaged state position.

8. The printing apparatus according to claim 1, wherein the distance is changed by rotation of the inclination control member without the inclination control member being moved in the first direction.

9. A printing apparatus comprising:

a carriage configured to move with a printing head mounted thereon, the print head being configured to perform printing on a printing medium;

a platen configured to support the printing medium on which the printing is performed by the printing head;

a first guide rail extending in a first direction that intersects a conveying direction of the printing medium;

a second guide rail extending in the first direction, the second guide rail being spaced apart from the first guide rail in the conveying direction;

a first guide member that is in contact with the first guide rail and that moves together with the carriage, the first guide member guiding the carriage in the first direction;

a second guide member that is in contact with the second guide rail and that moves together with the carriage, the second guide member guiding the carriage in the first direction;

an interval switching member configured to switch an interval between the carriage and the platen in a second direction that is orthogonal to the conveying direction and the first direction;

an inclination control member provided between the carriage and the interval switching member and configured to change a distance between the carriage and the interval switching member; and wherein an angle of the printing head with respect to the platen is adjusted by changing the distance by the inclination control member.

10. The printing apparatus according to claim 9, wherein the second guide rail member is provided downstream of the first guide rail in the conveying direction, and wherein the interval switching member includes a first interval switching member provided between the carriage and the first guide member and further includes a second interval switching member provided between the carriage and the second guide member, and the inclination control member is provided between the carriage and the second interval switching member.

11. The printing apparatus according to claim 10, wherein the carriage rotates around the first guide rail by changing the distance by the inclination control member.

12. The printing apparatus according to claim 9, wherein the first guide rail and the second guide rail are fixed on both sides of the printing head, the first guide rail is provided upstream of the printing head in the conveying direction, and the second guide rail is provided downstream of the printing head in the conveying direction.

13. The printing apparatus according to claim 9, wherein the inclination control member includes a bottom surface, and an upper surface formed of a plurality of flat surface portions parallel to the bottom surface, a thickness of the inclination control member being different at portions corresponding to the plurality of flat surface portions.

14. The printing apparatus according to claim 13, wherein the carriage includes an abutment surface that abuts against the upper surface of the inclination control member.

15. The printing apparatus according to claim 14, further comprising:

a position restriction portion that engages with the inclination control member so as to restrict a movement of the inclination control member in the first direction.

16. The printing apparatus according to claim 15, wherein the inclination control member is movable in a direction different from the first direction so as to cancel an engaged state with the position restriction portion, and wherein the printing apparatus further includes a biasing member that biases the inclination control member to an engaged state position.

17. The printing apparatus according to claim 9, wherein the distance is changed by rotation of the inclination control member without the inclination control member being moved in the first direction.

18. The printing apparatus according to claim 9, wherein the first direction is orthogonal to the conveying direction.

19. A printing apparatus comprising:

a carriage configured to move with a printing head mounted thereon, the print head being configured to perform printing on a printing medium;

a platen configured to support the printing medium on which the printing is performed by the printing head;

a first guide rail extending in a first direction that intersects a conveying direction of the printing medium;

a second guide rail extending in the first direction, the second guide rail being spaced apart from the first guide rail in the conveying direction;

a first guide member that is in contact with the first guide rail and that moves together with the carriage, the first guide member guiding the carriage in the first direction;

a second guide member that is in contact with the second guide rail and that moves together with the carriage, the second guide member guiding the carriage in the first direction;

an inclination control member provided between the first guide member and the carriage and configured to change a distance between the first guide member and the carriage; and wherein an angle of the printing head with respect to the platen is adjusted by changing the distance by the inclination control member.

* * * * *